US010350650B2

(12) United States Patent
Jones et al.

(10) Patent No.: US 10,350,650 B2
(45) Date of Patent: Jul. 16, 2019

(54) RELATING TO ULTRASONIC CLEANING

(71) Applicant: ALPHASONICS (ULTRASONIC CLEANING SYSTEMS) LTD, Prescot, Merseyside (GB)

(72) Inventors: David Stanley Jones, Prescot (GB); Neil Hodgson, Prescot (GB)

(73) Assignee: ALPHASONICS (ULTRASONIC CLEANING SYSTEMS) LTD., Prescot (GB)

( * ) Notice: Subject to any disclaimer, the term of this patent is extended or adjusted under 35 U.S.C. 154(b) by 611 days.

(21) Appl. No.: 14/435,784

(22) PCT Filed: Oct. 15, 2013

(86) PCT No.: PCT/GB2013/052693

§ 371 (c)(1),
(2) Date: Apr. 15, 2015

(87) PCT Pub. No.: WO2014/060744

PCT Pub. Date: Apr. 24, 2014

(65) Prior Publication Data

US 2016/0001333 A1 Jan. 7, 2016

(30) Foreign Application Priority Data

Oct. 15, 2012 (GB) ..... 1218470.1

(51) Int. Cl.

| | |
|---|---|
| ***B08B 3/10*** | (2006.01) |
| ***B08B 3/12*** | (2006.01) |
| ***B06B 1/02*** | (2006.01) |

(52) U.S. Cl.

CPC ..... *B08B 3/12* (2013.01); *B06B 1/0207* (2013.01); *B06B 1/0276* (2013.01); *B06B 1/0284* (2013.01); *B06B 2201/71* (2013.01)

(58) Field of Classification Search
None
See application file for complete search history.

(56) References Cited

U.S. PATENT DOCUMENTS

| | | | |
|---|---|---|---|
| 5,133,376 | A | 7/1992 | Samarin et al. |
| 2003/0028287 | A1 | 2/2003 | Puskas |

(Continued)

FOREIGN PATENT DOCUMENTS

| | | | |
|---|---|---|---|
| GB | 2446945 | A | 8/2008 |
| WO | 2005044440 | A2 | 5/2005 |

(Continued)

OTHER PUBLICATIONS

International Search Report for PCT/GB2013/052693 dated Jul. 28, 2014.

(Continued)

*Primary Examiner* — Mikhail Kornakov
*Assistant Examiner* — Ryan L. Coleman
(74) *Attorney, Agent, or Firm* — Shumaker, Loop & Kendrick, LLP

(57) ABSTRACT

An ultrasonic cleaning apparatus comprising: a tank for in use receiving a cleaning liquid and an item to be cleaned; a plurality of transducers arranged, when driven, to direct ultrasonic pressure waves into the tank; and a controller arranged in use to drive the transducers. First and second transducers from the plurality of transducers are arranged in use to direct ultrasonic pressure waves into an overlapping volume; and the controller is arranged in use to drive the first and second transducers to produce ultrasonic pressure waves at different frequencies from each other. The controller is arranged to in use produce first and second drive signals for the transducers using first and second frequency generators to each switch between primary and secondary operation, with the sequential switching taking place to cause different (Continued)

combinations of primary and secondary operation for the first and second frequency generators to occur over time.

9 Claims, 4 Drawing Sheets

(56) References Cited

U.S. PATENT DOCUMENTS

| | | | | |
|---|---|---|---|---|
| 2004/0182414 | A1 | 9/2004 | Puskas | |
| 2004/0256952 | A1 | 12/2004 | Puskas | |
| 2005/0122003 | A1* | 6/2005 | Goodson | B08B 3/12 310/334 |
| 2005/0188751 | A1* | 9/2005 | Puskas | B01J 19/10 73/64.56 |
| 2007/0182285 | A1 | 8/2007 | Goodson | |

FOREIGN PATENT DOCUMENTS

| | | | |
|---|---|---|---|
| WO | 2007/011520 | A2 | 1/2007 |
| WO | WO2011/038168 | * | 3/2011 |

OTHER PUBLICATIONS

UK Search Report for UK Patent Application No. GB1218470.1 dated Mar. 9, 2016.

* cited by examiner

RELATING TO ULTRASONIC CLEANING

CROSS REFERENCE TO RELATED APPLICATIONS

This application is a US National Stage application that claims the benefit of prior filed, co-pending, PCT application number PCT/GB2013/052693 filed on Oct. 15, 2013. Both this application and the aforementioned PCT application also claim priority to GB Application 1218470.1 filed on Oct. 15, 2012. Both the PCT application PCT/GB2013/052693 and the GB application 1218470.1 are herein incorporated by reference in their entireties.

TECHNICAL FIELD AND BACKGROUND OF THE INVENTION

The present invention relates to ultrasonic cleaning apparatus, to controllers for ultrasonic cleaning, and to related methods.

Ultrasonic cleaning typically involves immersing an item to be cleaned in a tank of cleaning liquid, then directing ultrasonic pressure waves into the tank. The pressure waves produce micro-cavitation in the liquid, which has a cleaning effect at the surface of the item to be cleaned.

In ultrasonic cleaning of this nature it is important to make good use of the ultrasound to increase efficiency. Problems can arise in distributing the ultrasonic pressure waves so that they are effective across the whole surface of the item to be cleaned, as standing waves linked to tank geometry can lead to the ultrasound in some parts of the tank being ineffective, and in other parts of the tank being too aggressive so as to potentially cause damage to the surface being cleaned.

Example embodiments of the present invention aim to address one or more problems associated with the prior art, for example those problems set out above.

SUMMARY OF THE INVENTION

In one example embodiment, the present invention provides an ultrasonic cleaning apparatus comprising:

a tank for in use receiving a cleaning liquid and an item to be cleaned;

a plurality of transducers arranged, when driven, to direct ultrasonic pressure waves into the tank; and a controller arranged in use to drive the transducers;

wherein first and second transducers from the plurality of transducers are arranged in use to direct ultrasonic pressure waves into an overlapping volume, and wherein the controller is arranged in use to drive the first and second transducers to produce ultrasonic pressure waves at different frequencies from each other.

Suitably, the plurality of transducers is arranged with transducers grouped into first and second groups, with transducers of the first group arranged with one or more transducers of the second group located therebetween.

Suitably, the plurality of transducers is arranged with the transducers grouped into first and second groups, and wherein the controller is arranged to drive transducers of the first group at a first frequency and to drive transducers of the second group at a second frequency, the second frequency being different from the first.

Suitably, the plurality of transducers is configured with transducers of the first group and transducers of the second group in alternating arrangement in one dimension across the tank, or in two dimensions across the tank.

Suitably, the plurality of transducers is configured with one, two or more first transducers having one, two or more second transducers adjacent thereto in order to direct, when driven by the controller, pressure waves into a plurality of overlapping volumes.

Suitably, the plurality of transducers includes a third transducer, such that in use the second and third transducers are arranged, when driven by the controller to direct ultrasonic waves into an overlapping volume, that volume itself at least partially overlapping with the overlapping volume of the first and second transducers.

Suitably, the controller is arranged in use to drive the first and third transducers at the same frequency.

Suitably, the controller is arranged in use to produce a drive signal for the transducers that is characterised by a centre frequency, a sweep range about the centre frequency and a sweep rate.

Suitably, the controller is arranged to in use produce first and second drive signals for the transducers, which are each characterised by a centre frequency, a sweep range about the centre frequency and a sweep rate.

Suitably, the controller is arranged in use to supply the first and second drive signals to the first and second transducers or first and second transducer groups.

Suitably, the controller comprises a first frequency generator arranged to supply a first drive signal that comprises a primary centre frequency, sweep range and sweep rate, and a secondary centre frequency, sweep range and sweep rate.

Suitably, the controller comprises a second frequency generator arranged to supply a second drive signal that comprises a primary centre frequency, sweep range and sweep rate, and a secondary centre frequency, sweep range and sweep rate.

Suitably, the controller is arranged in use to control the first and second frequency generator to switch between primary and secondary operation.

Suitably, the controller is arranged in use to control the first and second frequency generators to each switch between primary and secondary operation, with the sequential switching taking place to cause different combinations of primary and secondary operation for the first and second frequency generators to occur over time, for example in sequence. Suitably, a switch in primary or secondary operation occurs every one minute, two minutes, or every five minutes, for example.

Suitably, the controller is further arranged in use to vary the sweep rate over time, for example by switching between a first sweep rate and a second sweep rate.

In another example embodiment, the present invention provides a controller for an ultrasonic cleaning apparatus, the controller comprising:

a first frequency generator arranged in use to generate a first drive signal for supply to a first transducer; and a second frequency generator arranged in use to generate a second drive signal for supply to a second transducer;

wherein the first and second drive signals are each characterised by a centre frequency, a sweep range about the centre frequency and a sweep rate.

Suitably, the first drive signal comprises, in primary operation of the first frequency generator, a primary centre frequency, sweep range and sweep rate, and in secondary operation of the first frequency generator a secondary centre frequency, sweep range and sweep rate.

Suitably, the second drive signal comprises, in primary operation of the second frequency generator, a primary centre frequency, sweep range and sweep rate, and in secondary operation of the second frequency generator a secondary centre frequency, sweep range and sweep rate.

Suitably, the controller is arranged in use to control the first frequency generator to switch between primary and secondary operation.

Suitably, the controller is arranged in use to control the second frequency generator to switch between primary and secondary operation.

Suitably, the controller is arranged in use to control the first and second frequency generators to each switch between primary and secondary operation, with the sequential switching taking place to cause different combinations of primary and secondary operation for the first and second frequency generators to occur over time, for example in sequence and/or cyclically. Suitably, a switch in primary or secondary operation occurs every one minute, two minutes, or every five minutes for example.

Suitably, the controller is arranged in use to vary the sweep rate of first and/or second drive signals over time, for example by switching between a first sweep rate and a second sweep rate in one or both of primary and secondary operation of the first and/or second frequency generators.

In other example embodiments the present invention provides methods of ultrasonic cleaning, comprising use of the ultrasonic cleaning apparatus or controller as set out above.

BRIEF DESCRIPTION OF THE DRAWINGS

For a better understanding of the invention, and to show how embodiments of the same may be carried into effect, reference will now be made, by way of example, to the accompanying diagrammatic drawings in which.

DETAILED DESCRIPTION OF THE PREFERRED EMBODIMENTS AND BEST MODE

Figure 1:
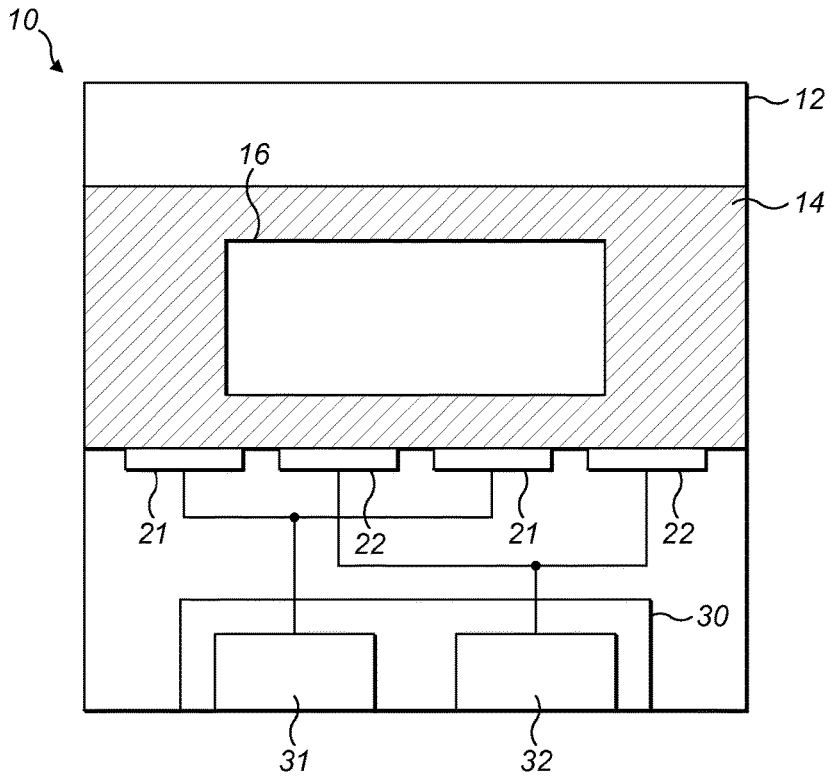
FIG. 1 shows a side schematic view of an ultrasonic cleaning apparatus according to an example embodiment.

Referring now to FIG. 1 there is shown a schematic overview of an ultrasonic cleaning apparatus in accordance with an example embodiment. The ultrasonic cleaning apparatus 10 comprises a tank 12 which in use receives a cleaning liquid 14 and an item to be cleaned 16. The tank 12 may also be provided with a support rack, frame or other structure (not shown) in order to hold the item to be cleaned 16 in place in the cleaning liquid 14.

The ultrasonic cleaning apparatus of FIG. 1 further includes a plurality of transducers 21, 22 arranged, when driven, to direct ultrasonic pressure waves into the tank. The transducers 21, 22 are operatively coupled to a controller 30, which is supplied with power and is arranged in use to drive the transducers 21, 22 so that they emit ultrasonic pressure waves into the tank 12.

First and second transducers 21, 22 from the plurality of transducers are arranged in use to direct ultrasonic pressure waves into an overlapping volume in the tank 12. Furthermore, the controller 30 is arranged in use to drive the first and second transducers 21, 22 in the plurality of transducers to produce ultrasonic pressure waves at different frequencies from each other, with first and second generators 31, 32 shown as coupled to the first transducers 21 and second transducers 32 respectively.

In this way the spread of ultrasonic pressure waves in the tank 12 can be given a more effective distribution.

Figure 2:
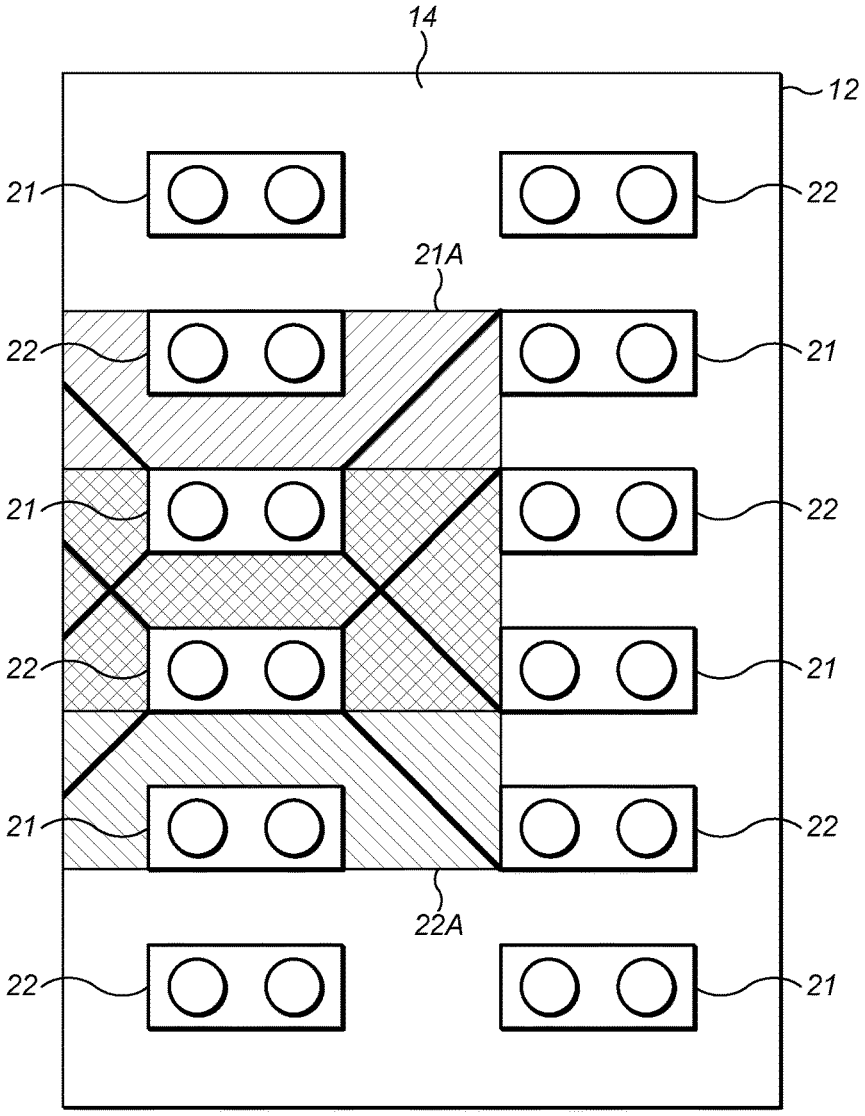
FIG. 2 shows a schematic plan view of a tank of an ultrasonic cleaning apparatus according to another example embodiment.

FIG. 2 shows a schematic plan view of how twelve transducers are arranged in one example embodiment, with a first plurality of transducers 21 arranged in a first group and a second plurality of transducers 22 arranged in a second group. Transducers of the first group arranged with one or more transducers of the second group located therebetween, when considering transducers in each of the columns of transducers running from top to bottom of FIG. 2. In addition, when considering the rows of transducers running across FIG. 2 in sequence the transducers are arranged alternatingly from the first and second group, in a pattern that continues from row to row.

Figure 3:
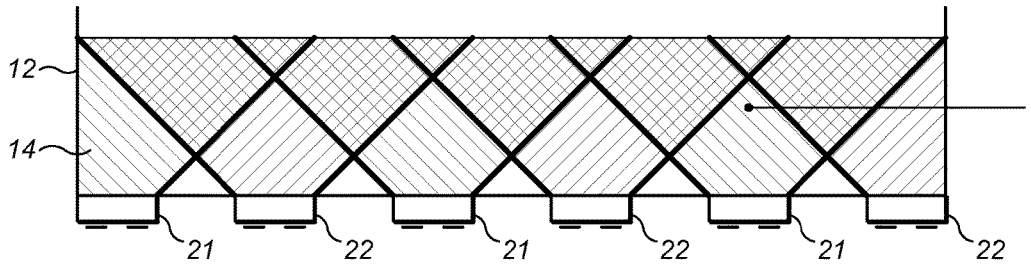
FIG. 3 a schematic side view of the tank of FIG. 2.

As can be understood from the hatched areas shown in FIG. 2, and the corresponding areas shown in FIG. 3, pressure waves from the transducer in the left column and third row, which is a transducer from the first plurality of transducers 21, are emitted into the volume above the transducer, identified by the rectangular area 21A approximately centred on this transducer. Pressure waves from the transducer in the left column and fourth row, which is adjacent to the transducer of the left column, third row, and which is transducers from the second plurality of transducers 22, are emitted into the volume above the transducer, identified by the rectangular area 22A. The diagonal hatchings indicate the volume into which the pressure waves from these transducers are emitted, with the cross-hatched area indicating the volume where there is overlap. As can be appreciated from schematic side view of FIG. 3, the transducers from the first and second pluralities, when driven, give rise to significant overlapping volumes where the effect of both first and second pluralities of transducers are felt, enhanced in the example embodiment shown by the existence of third, and subsequent transducers arranged inline with one another, and the second bank of transducers arranged in a corresponding line of transducers alternating between first and second groups and arranged next to the first bank of transducers. In the embodiment shown each bank of transducers comprises six transducers. In this way the ultrasonic cleaning apparatus is arranged such that in use the first and second, and the second and third transducers are arranged, when driven by the controller 30 to direct ultrasonic waves into an overlapping volume.

Figure 4:
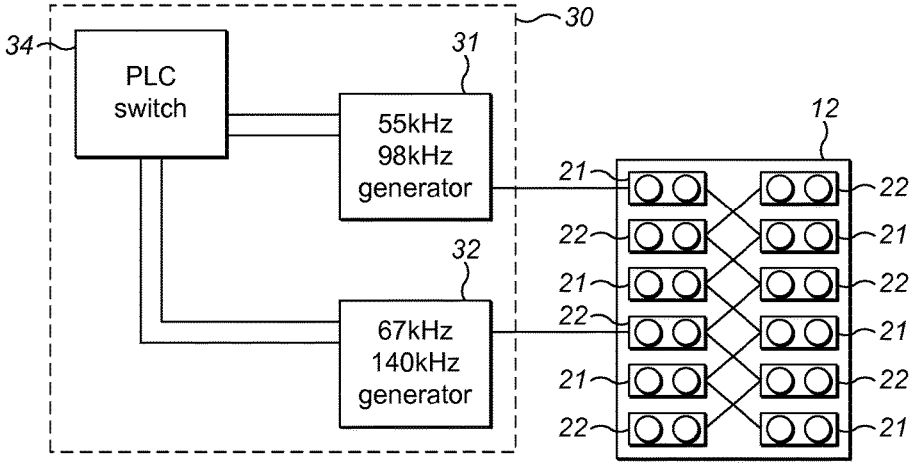
FIG. 4 shows a schematic view of the tank of FIG. 2 coupled to a controller according to an example embodiment.

FIGS. 1 and 4 show examples of how the transducers from the first and second pluralities of transducers 21, 22 are coupled to frequency generators in a controller 30. Referring to FIG. 4, the plurality of transducers is arranged with the transducers grouped into first and second groups, and the controller 30 is arranged to drive transducers of the first group at a first frequency and to drive transducers of the second group at a second frequency, the second frequency being different from the first.

The controller 30 uses a first generator 31 to produce a drive signal for the transducers in the first group 21 that is characterised by a centre frequency, a sweep range about the centre frequency and a sweep rate. The controller 30 uses a second generator 32 to produce a drive signal for the transducers in the second group 22 that is characterised by a centre frequency, a sweep range about the centre frequency and a sweep rate. In the example embodiment shown, each generator is a 500 W generator.

In example embodiments the first and second generators are each arranged to operate in primary and secondary operation modes, and to switch between primary and secondary operation modes under the control of a switch 34. The switch 34 is conveniently realised using a programmable logic controller.

In one example embodiment, the first frequency generator 31 is arranged to supply when operating in a primary operation mode, a first drive signal that comprises a primary centre frequency of 55 kHz, sweep range of 20 kHz and sweep rate of 120 Hz. In this example embodiment the first frequency generator 31 is arranged to supply, when operating in a secondary operation more, a first drive signal that comprises a secondary centre frequency of 98 kHz, sweep range of 20 kHz and sweep rate of 120 Hz.

In one example embodiment, the second frequency generator 32 is arranged to supply, when operating in a primary operation mode, a first drive signal that comprises a primary centre frequency of 67 kHz, sweep range of 17 kHz and sweep rate of 120 Hz. In this example embodiment the first frequency generator 31 is arranged to supply, when operating in a secondary operation more, a first drive signal that comprises a secondary centre frequency of 140 kHz, sweep range of 17 kHz and sweep rate of 120 Hz.

The controller 30 is arranged in use to control the first and second frequency generators 31, 32 to each switch between primary and secondary operation. In example embodiments, the sequential switching causes different combinations of primary and secondary operation for the first and second frequency generators to occur over time, for example in sequence. For example, the sequence may cycle through as follows:

First generator primary operation with second generator primary operation;

First generator primary operation with second generator secondary operation;

First generator secondary operation with second generator primary operation;

First generator secondary operation with second generator secondary operation.

The controller 30 is further arranged in use to vary the sweep rate over time, for example by switching between a first sweep rate and a second sweep rate. For example, the sweep rate may be switched between 120 Hz and 380 Hz on a periodic basis every few seconds, such as for example every few seconds. In the example embodiment this is every seven seconds. The cycling through primary and secondary operation of the first and second generators may occur on a fixed or variable timescale for example with a change every few minutes as operation of the controller cycles through the four different combinations of drive signal. The cycle can, in other embodiments, be stepped through in regular sequence but in a different order, or in random sequence Other generators operating at different centre frequency, sweep range and sweep rate are envisaged, for example with primary operation frequencies of 43 kHz and 55 kHz for the first and second generators respectively, and secondary operation frequencies of 67 kHz and 98 kHz for the first and second generators respectively. Other example embodiments may provide centre frequencies of 43 kHz, 55 kHz, 98 kHz, and, 100 kHz or 120 kHz. In other example embodiments the sweep range may be in the region of 10 kHz to 20 kHz. In other example embodiments the sweep rate may switch between 120 Hz and a rate in the range 280 Hz to 400 Hz.

Figure 5:
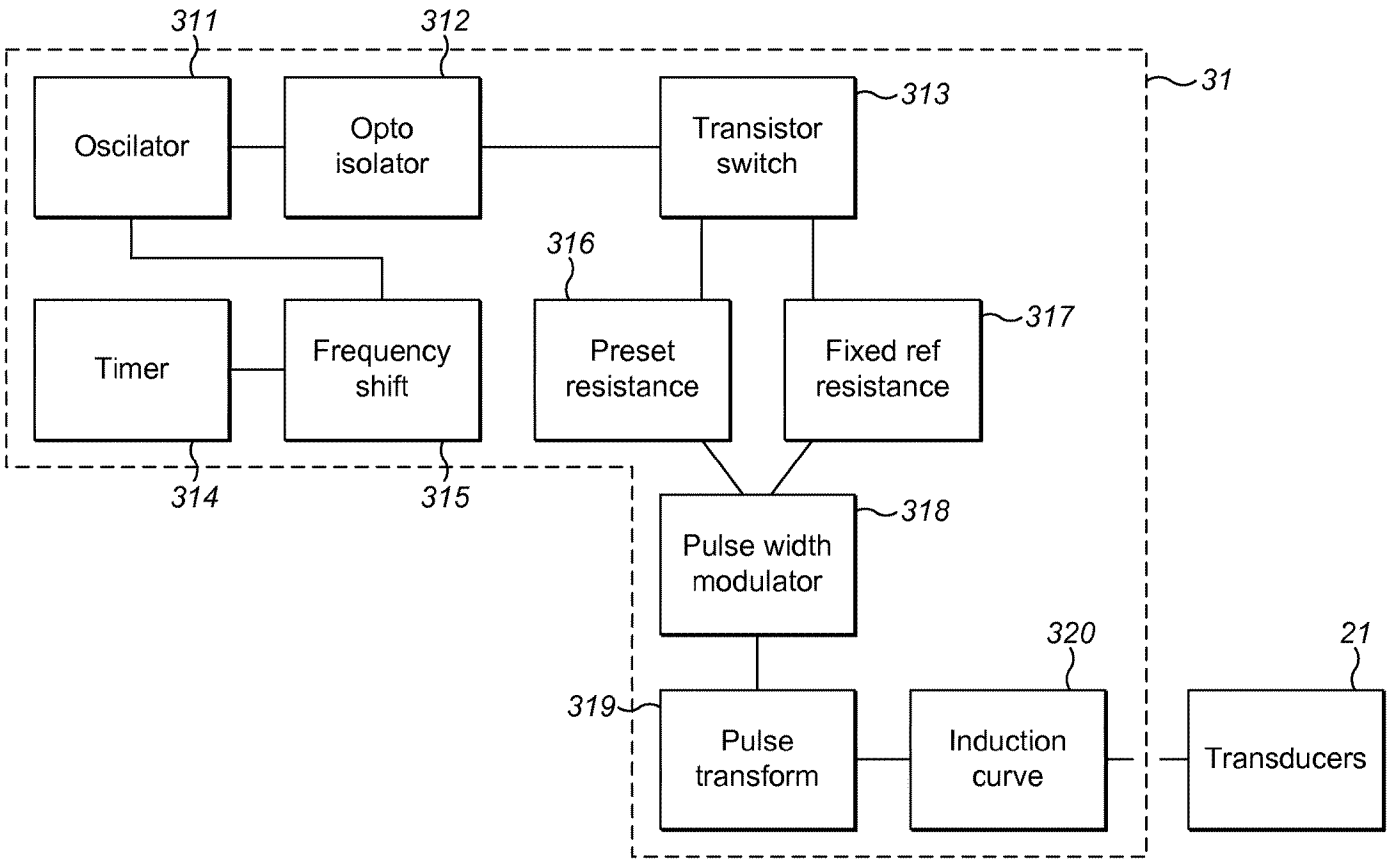
FIG. 5 shows a schematic block diagram of a first frequency generator of the controller of FIG. 4.

FIG. 5 shows a schematic block diagram of the first frequency generator 31, which is provided as an active oscillator. The oscillator 311 provides its output to a transistor switch 313 through an optical isolator 312. A timer 314 controls the switching in and out of the frequency shift unit 315, thereby varying the sweep range according to the time period set by the timer. The transistor switch 313 is coupled to a preset resistance 316 and a fixed reference resistance 317, and by switching in and out the preset resistance over time the generator switches between first and second operation modes. The pulse width modulator 318, pulse transform unit 319 and induction curve 320 provide the output in a form suitable for the transducers 21.

As set out above, ultrasonic cleaners according to example embodiments provide a good variation in frequencies, such that two generators can be used effectively to reduce the presence of hot and cold spots in the tank. By use of suitable cleaning liquids it is possible to give a good cleaning effect on delicate items, for example items of medical or surgical equipment, without causing significant surface erosion or other damage.

Although a few preferred embodiments have been shown and described, it will be appreciated by those skilled in the art that various changes and modifications might be made without departing from the scope of the invention, as defined in any appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. An ultrasonic cleaning apparatus comprising:

a tank for receiving a cleaning liquid and an item to be cleaned;

a plurality of transducers arranged, when driven, to direct ultrasonic pressure waves into the tank; and a controller configured to drive the transducers, wherein:

first and second transducers from the plurality of transducers are configured to direct ultrasonic pressure waves into an overlapping volume; and the controller is configured to drive the first and second transducers to produce ultrasonic pressure waves at different frequencies from each other, wherein the controller is configured to in use produce first and second drive signals for the first and second transducers, wherein the drive signals are each characterized by a center frequency, a sweep range about the center frequency and a sweep rate; and the controller is configured to supply the first and second drive signals to the first and second transducers respectively or to groups of first and second transducers from the plurality of transducers respectively, such that the controller comprises a first frequency generator configured to supply a first drive signal that comprises a primary center frequency, sweep range and sweep rate, and a secondary center frequency, sweep range and sweep rate; and the controller comprises a second frequency generator configured to supply a second drive signal that comprises a primary center frequency, sweep range and sweep rate, and secondary center frequency, sweep range and sweep rate; wherein the controller is configured to control the first and second frequency generators to each switch between primary operation at a first center frequency and secondary operation at a second center frequency, with switching taking place to cause different combinations of primary and secondary operation for the first and second frequency generators to occur cyclically over time during cleaning.

2. The ultrasonic cleaning apparatus of claim 1, wherein the plurality of transducers is arranged with transducers grouped into first and second groups, with transducers of the first group arranged with one or more transducers of the second group located therebetween.

3. The ultrasonic cleaning apparatus of claim 1, wherein the plurality of transducers is arranged with the transducers grouped into first and second groups, and wherein the controller is arranged to drive transducers of the first group at a first frequency and to drive transducers of the second group at a second frequency, the second frequency being different from the first.

4. The ultrasonic cleaning apparatus of claim 1, wherein the plurality of transducers is configured with transducers of the group of first transducers and the group of second transducers in alternating arrangement in one dimension across the tank, or in two dimensions across the tank.

5. The ultrasonic cleaning apparatus of claim 1, wherein the plurality of transducers is configured with one, two or more first transducers having one, two or more second transducers adjacent thereto in order to direct, when driven by the controller, pressure waves into a plurality of overlapping volumes.

6. The ultrasonic cleaning apparatus of claim 2, wherein the plurality of transducers includes a third transducer, such that in use the second and third transducers are arranged, when driven by the controller to direct ultrasonic waves into an overlapping volume, that volume itself at least partially overlapping with the overlapping volume of the first and second transducers.

7. The ultrasonic cleaning apparatus of claim 6, wherein the controller is arranged in use to drive the first and third transducers at the same frequency.

8. The ultrasonic cleaning apparatus of claim 1, wherein the controller is further configured to vary a sweep rate over time.

9. A method of ultrasonic cleaning performed in the ultrasonic cleaning apparatus of claim 1, comprising the steps of:

generating a first drive signal for supply to a first transducer; and generating a second drive signal for supply to a second transducer, wherein the first and second drive signals are each characterized by a center frequency, a sweep range about the center frequency and a sweep rate wherein:

generating the first drive signal or the second drive signal comprises switching between primary and secondary operation, with the sequential switching taking place to cause different combinations of primary and secondary operation for the first and second drive signals to occur over time;

in primary operation, the first or second drive signal comprises a primary center frequency, sweep range and sweep rate; and in secondary operation, the first and second drive signal comprises a secondary center frequency, sweep range and sweep rate, and further comprising the step of:

varying the sweep rate of the first and/or second drive signals over time by switching between a first sweep rate and a second sweep rate in one or both of primary and secondary operation.

* * * * *